US011694593B2

(12) United States Patent
Liu

(10) Patent No.: US 11,694,593 B2
(45) Date of Patent: Jul. 4, 2023

(54) DISPLAY PANEL AND DISPLAY DEVICE

(71) Applicant: TCL CHINA STAR OPTOELECTRONICS TECHNOLOGY CO., LTD., Shenzhen (CN)

(72) Inventor: Jinfeng Liu, Shenzhen (CN)

(73) Assignee: TCL CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 316 days.

(21) Appl. No.: 17/252,402

(22) PCT Filed: Nov. 30, 2020

(86) PCT No.: PCT/CN2020/132578
§ 371 (c)(1),
(2) Date: Dec. 15, 2020

(87) PCT Pub. No.: WO2022/077718
PCT Pub. Date: Apr. 21, 2022

(65) Prior Publication Data

US 2022/0301480 A1 Sep. 22, 2022

(30) Foreign Application Priority Data

Oct. 15, 2020 (CN) ..... 202011102306.X

(51) Int. Cl.
*G09G 3/20* (2006.01)

(52) U.S. Cl.
CPC ... *G09G 3/2007* (2013.01); *G09G 2300/0828* (2013.01); *G09G 2310/027* (2013.01);
(Continued)

(58) Field of Classification Search
CPC ..... G09G 3/2007; G09G 2300/0828; G09G 2310/027; G09G 2310/0286;
(Continued)

(56) References Cited

U.S. PATENT DOCUMENTS

2010/0289839 A1 11/2010 Min
2011/0199353 A1* 8/2011 Chung ..... G11C 19/00 345/208

FOREIGN PATENT DOCUMENTS

CN 101013566 A 8/2007
CN 101281337 A 10/2008
(Continued)

*Primary Examiner* — Kenneth B Lee, Jr.
(74) *Attorney, Agent, or Firm* — The Roy Gross Law Firm, LLC; Roy Gross

(57) ABSTRACT

The present disclosure provides a display panel and a display device. The display panel includes source driver chips. The source driver chips include charging compensation modules, and each of the charging compensation modules includes: a plurality of shift registers cascadely connected and configured to time-divisionally output a plurality of pulse signals, and a plurality of level shift circuits time-divisionally conducted in response to the plurality of the pulse signals to prevent the plurality of the level shift circuits in the source driver chips from outputting and generating a plurality electron currents at a same time, which would result in a superposition of current peaks and cause electromagnetic interference problems.

19 Claims, 13 Drawing Sheets

(52) U.S. Cl.
CPC ..... *G09G 2310/0286* (2013.01); *G09G 2310/0289* (2013.01); *G09G 2310/0291* (2013.01); *G09G 2310/08* (2013.01); *G09G 2330/06* (2013.01)

(58) Field of Classification Search
CPC ... G09G 2310/0289; G09G 2310/0291; G09G 2310/08; G09G 2330/06
See application file for complete search history.

(56) References Cited

FOREIGN PATENT DOCUMENTS

| | | | |
|---|---|---|---|
| CN | 101320540 | A | 12/2008 |
| CN | 101377908 | A | 3/2009 |
| CN | 102034416 | A | 4/2011 |
| CN | 102157126 | A | 8/2011 |
| CN | 102237030 | A | 11/2011 |
| CN | 102542976 | A | 4/2012 |
| CN | 103208250 | A | 7/2013 |
| CN | 204834004 | U | 12/2015 |
| CN | 109243355 | A | 1/2019 |
| CN | 110910811 | A | 3/2020 |
| CN | 110910834 | A | 3/2020 |
| JP | 2000098334 | A | 4/2000 |

* cited by examiner

DISPLAY PANEL AND DISPLAY DEVICE

CROSS REFERENCE TO RELATED APPLICATIONS

This application is a National Phase of PCT Patent Application No. PCT/CN2020/132578 having International filing date of Nov. 30, 2020, which claims the benefit of priority of Chinese Application No. 202011102306.X filed on Oct. 15, 2020. The contents of the above applications are all incorporated by reference as if fully set forth herein in their entirety.

BACKGROUND

Field of Invention

The present disclosure relates to the field of display technologies, and particularly to a display panel and a display device.

Description of Prior Art

Making display devices meet requirements of high resolution and high refresh rate has become a focus of development of display technologies. To meet the requirements of the display devices with high resolution and high refresh rate, a point-to-point transmission protocol mode is usually used to achieve high-rate transmission of signals. However, in this transmission mode, level shift circuits of a programmable panel charging compensation (PPCC) module in each source driver chip corresponding to different channels output at a same time, and generated electron currents are prone to cause a superposition of electron current peaks, leading to a problem of electromagnetic interference and affecting reliability of products.

SUMMARY

Embodiments of the present disclosure provide a display panel and a display device, which can avoid a problem of electromagnetic interference caused by a superposition of current peaks of source driver chips and ensure reliability of products.

Embodiments of the present disclosure provide a display panel including source driver chips, the source driver chips include charging compensation modules, and each of the charging compensation modules includes:

a plurality of shift registers cascadely connected and configured to time-divisionally output a plurality of pulse signals in response to a clock signal and a cascaded control signal; and a plurality of level shift circuits, wherein each of the level shift circuits is connected to a corresponding the shift register, and the plurality of the level shift circuits are configured to be time-divisionally conducted in response to the plurality of the pulse signals.

In some embodiments, the display panel includes a plurality of the source driver chips, each of the source driver chips includes one of the charging compensation modules, the shift registers in a plurality of the charging compensation modules output the plurality of the pulse signals in response to the clock signal and the cascaded control signal simultaneously, parts of the level shift circuits in the plurality of the charging compensation modules are simultaneously conducted in response to corresponding parts of the pulse signals, and the plurality of the level shift circuits in a same charging compensation module are time-divisionally conducted in response to the pulse signals correspondingly.

In some embodiments, the display panel includes a plurality of the source driver chips, each of the source driver chips includes one of the charging compensation modules, the shift registers in a plurality of the charging compensation modules output the plurality of the pulse signals in response to the clock signal and the cascaded control signal sequentially, and the plurality of the level shift circuits in the plurality of the charging compensation modules are time-divisionally conducted in response to the pulse signals correspondingly and sequentially.

In some embodiments, the display panel includes the source driver chips with x levels, one of the charging compensation modules corresponding to a source driver chip at a y−1th level includes the shift registers with n levels, the cascaded control signal responded by one level of the shift registers in a corresponding charging compensation module of a source driver chip at a yth level lags behind the cascaded control signal responded by one level of the shift registers in a corresponding charging compensation module of the source driver chip at the y−1th level by n clock cycles, wherein y is greater than 1.

In some embodiments, the display panel includes the source driver chips with x levels, and the cascaded control signal responded by one level of the shift registers in a corresponding one of the charging compensation modules of one of the source driver chips at a yth level lags behind the cascaded control signal responded by one level of the shift registers in a corresponding charging compensation module of the source driver chips at a y−1th level by $1*\Delta T-40*\Delta Ts$, wherein y is greater than 1, and $\Delta T$ refers to a unit period.

In some embodiments, the unit period $\Delta T$ is greater than or equal to 1*UI, wherein the UI and a transmission speed of the source driver chips are reciprocal to each other.

In some embodiments, $\Delta T$ is greater than or equal to 3.3 nanoseconds.

In some embodiments, the cascaded control signal includes a start signal, and a first-level shift register in each of the charging compensation modules outputs a first-level pulse signal in response to the clock signal and the start signal.

In some embodiments, the display panel further includes a timing controller, and the timing controller is configured to generate the clock signal and the start signal.

In some embodiments, each of the charging compensation modules includes the shift registers with n levels, and one of the shift registers at an mth level outputs an mth level pulse signal in response to the clock signal and a m−1th level pulse signal output by one of the shift registers at a m−1th level, wherein m is greater than 1 and less than or equal to n.

In some embodiments, each of the source driver chips further includes a latch, and the latch includes a charging compensation module.

In some embodiments, the latch further includes:

a first latch module configured to latch display data of a next row;

a second latch module connected to the first latch module and configured to latch display data of a current row; and a third latch module connected to the second latch module and configured to realize an output delay of the display data of the current row, and the third latch module including the corresponding one of the charging compensation module.

In some embodiments, each of the source driver chips further includes:

a digital analog converter connected to the latch and configured to convert a voltage signal output by one of the level shift circuits into a grayscale voltage signal; and a data buffer connected to the digital analog converter and configured to output an electron current for driving the display panel to display.

In some embodiments, each of the source driver chips further includes a data receiving module, and the data receiving module is configured to store data of an extra bus line according to an input clock signal.

In some embodiments, the data receiving module includes:

a data register configured to store the data; and a first shift register configured to output a pulse signal according to the input clock signal and control the data register gating correspondingly, so as to sequentially store the data into the data register.

The present disclosure further provides a display device including the above-mentioned display panel.

Compared with prior art, In the display panel and the display device provided by the embodiments of the present disclosure, the display panel includes source driver chips, the source driver chips include charging compensation modules, and each of the charging compensation modules includes: a plurality of shift registers cascadely connected and configured to time-divisionally output a plurality of pulse signals in response to a clock signal and a cascaded control signal; and a plurality of level shift circuits, wherein each of the level shift circuits is connected to a corresponding shift register, and the plurality of the level shift circuits are configured to be time-divisionally conducted in response to the plurality of the pulse signals, so as to prevent the plurality of the level shift circuits in the source driver chips from outputting and generating a plurality electron currents at a same time, resulting in a superposition of current peaks, causing a problem of electromagnetic interference.

DETAILED DESCRIPTION OF EMBODIMENTS

In order to make purposes, technical solutions, and effects of the present disclosure clearer, the present disclosure will be further described in detail below with reference to the accompanying drawings and embodiments. It should be understood that specific embodiments described herein are merely used to explain the present disclosure and are not intended to limit the present disclosure.

Figure 1:
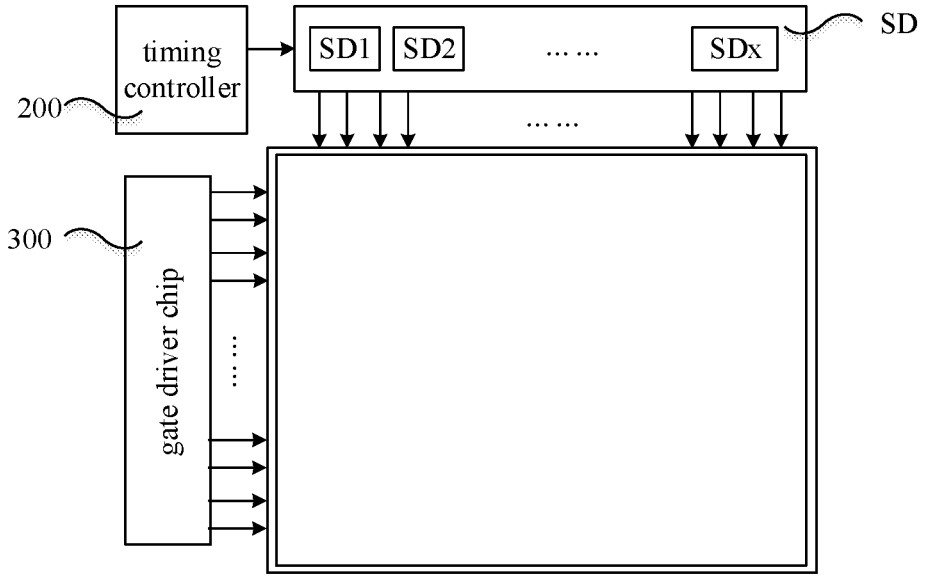
FIG. 1 is a schematic view of a display panel provided by an embodiment of the present disclosure.
Figure 2:
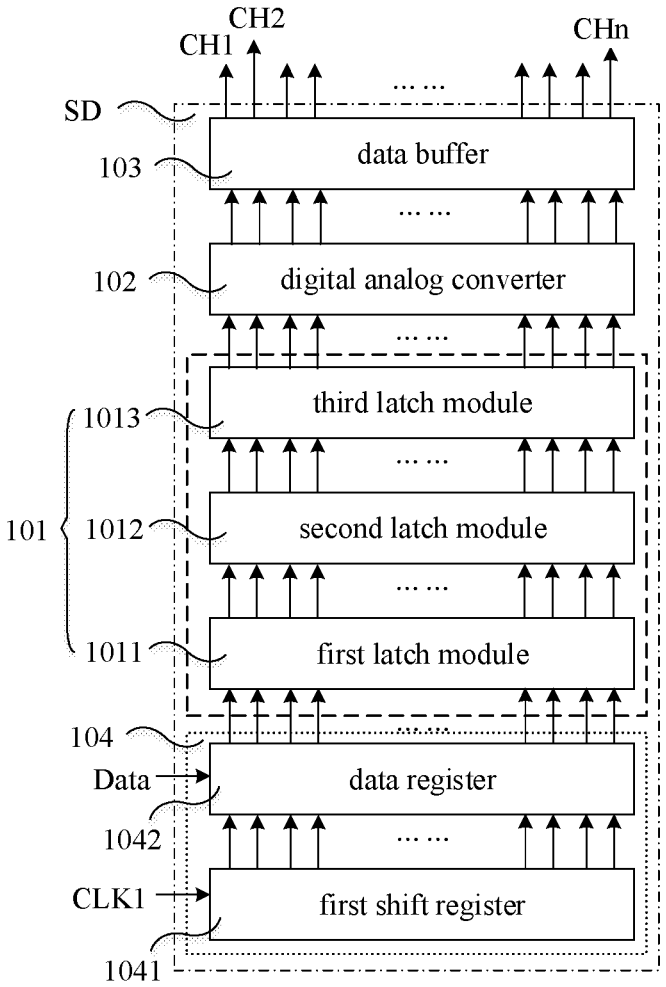
FIG. 2 is a schematic view of one of source driver chips provided by an embodiment of the present disclosure.
Figure 3:
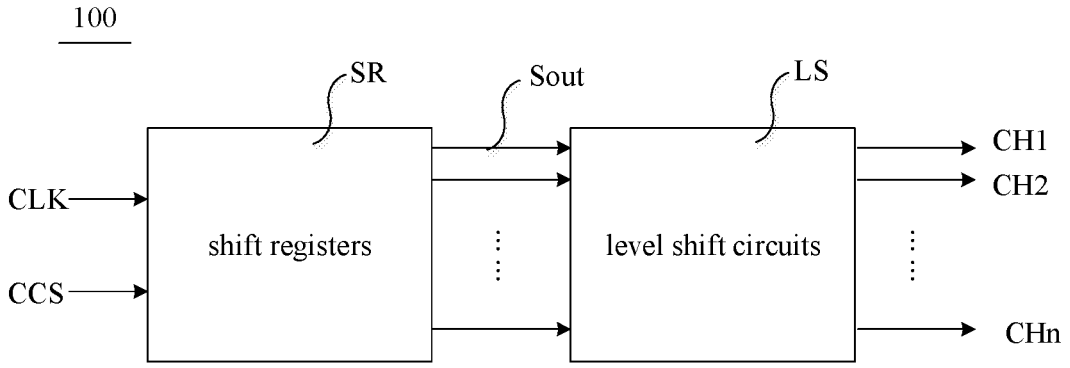
FIG. 3 is a schematic view of one of charging compensation modules provided by an embodiment of the present disclosure.
Figure 4A:
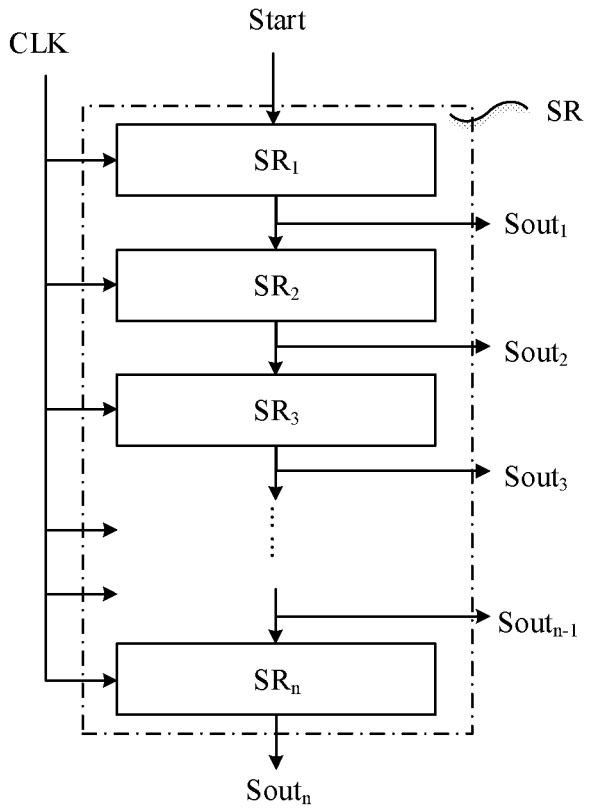
FIG. 4A is a schematic view of a plurality of shift registers cascadely connected provided by an embodiment of the present disclosure.
Figure 4B:
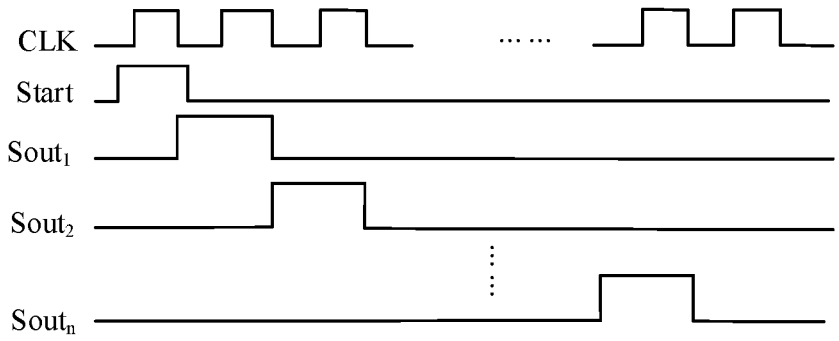
FIG. 4B is an output timing view of the plurality of the shift registers cascadely connected provided by an embodiment of the present disclosure.
Figure 4C:
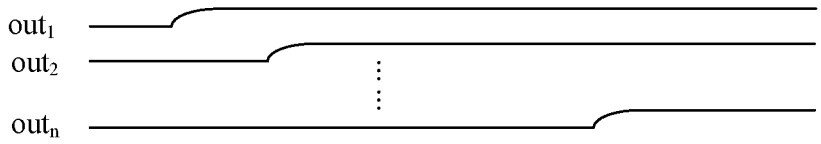
FIG. 4C is an output timing diagram of the charging compensation modules provided by an embodiment of the present disclosure.
Figure 4D:
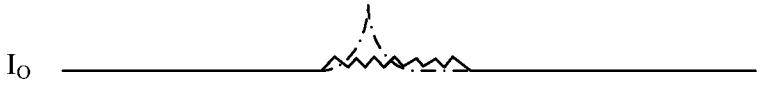
FIG. 4D is a schematic view of a superposition of electron currents generated by outputs of a plurality of level shift circuits provided by an embodiment of the present disclosure.

Specifically, please refer to FIG. 1. FIG. 1 is a schematic view of a display panel provided by an embodiment of the present disclosure. As shown in FIG. 2, FIG. 2 is a schematic view of one of source driver chips provided by an embodiment of the present disclosure. As shown in FIG. 3, FIG. 3 is a schematic view of one of charging compensation modules provided by an embodiment of the present disclosure. As shown in FIG. 4A, FIG. 4A is a schematic view of a plurality of shift registers cascadely connected provided by an embodiment of the present disclosure. As shown in FIG. 4B, FIG. 4B is an output timing diagram of the plurality of the shift registers cascadely connected provided by an embodiment of the present disclosure. As shown in FIG. 4C, FIG. 4C is an output timing diagram of the charging compensation modules provided by an embodiment of the present disclosure. As shown in FIG. 4D, FIG. 4D is a schematic view of a superposition of electron current generated by outputs of a plurality of level shift circuits provided by an embodiment of the present disclosure.

An embodiment of the present disclosure provides a display panel including source driver chips (SD). The source driver chips (SD) include charging compensation modules 100, and each of the charging compensation modules 100 includes:

a plurality of shift registers (SR) cascadely connected and configured to time-divisionally output a plurality of pulse signals (Sout) in response to a clock signal (CLK) and a cascaded control signal (CCS); and a plurality of level shift circuits (LS), wherein each of the level shift circuits (LS) is connected to a corresponding shift register (SR), and the plurality of the level shift circuits (LS) are configured to be time-divisionally conducted in response to the plurality of the pulse signals (Sout), so that the plurality of the level shift circuits (LS) in a same source driver chip (SD) output time-divisionally, thereby generating a plurality of electron currents time-divisionally and avoiding a problem of electromagnetic interference caused by a superposition of electron current peaks and improving reliability of products.

Specifically, the cascaded control signal (CCS) includes a start signal (Start), and a first-level shift register ($SR_1$) of the plurality of the shift registers (SR) cascadely connected in each of the charging compensation modules 100 outputs a first-level pulse signal ($Sout_1$) in response to the clock signal (CLK) and the start signal (Start).

Further, the cascaded control signal (CCS) includes a stage-shift signal, and the stage-shift signal includes the pulse signals (Sout) output by the plurality of the shift registers (SR), so that the pulse signals can be time-divisionally output by the shift registers with a plurality levels cascadely connected to the first-level shift register ($SR_1$) and in response to the shift registers with previous q levels simultaneously, wherein the q is greater than or equal to 1. That is, if the q is equal to 1 and each of the charging compensation modules 100 includes the shift registers (SR) with n levels, a shift register ($SR_m$) at an mth level outputs an mth level pulse signal ($Sout_m$) in response to the clock signal (CLK) and an m−1th level pulse signal ($Sout_{m-1}$) output by one of the shift registers ($SR_{m-1}$) at an m−1th level. Wherein m is greater than 1 and less than or equal to n.

Correspondingly, the plurality of the level shift circuits (LS) are time-divisionally conducted in response to the pulse signals (Sout) correspondingly. Specifically, each of the charging compensation modules 100 includes the shift registers (SR) with n levels, and the first-level shift register ($SR_1$) outputs the first-level pulse signal ($Sout_1$) in response to the clock signal (CLK) and the start signal (Start). A level shift circuit (LS) corresponding to the first-level shift register ($SR_1$) is conducted in response to the first-level pulse signal ($Sout_1$), and a second level shift register ($SR_2$) outputs a second level pulse signal ($Sout_2$) in response to the clock signal (CLK) and the first-level pulse signal ($Sout_1$) output by the first-level shift register ($SR_1$). A level shift circuit (LS) corresponding to the second level shift register ($SR_2$) is conducted in response to the second level pulse signal ($Sout_2$), and a third level shift register ($SR_3$) outputs a third level pulse signal ($Sout_3$) in response to the clock signal (CLK) and the second level pulse signal ($Sout_2$) output by the second level shift register ($SR_2$). Hence, until a shift register ($SR_n$) at an nth level outputs an nth level pulse signal ($Sout_n$) in response to the clock signal (CLK) and an n−1th level pulse signal ($Sout_{n-1}$), and a level shift circuit (LS) corresponding to the shift register ($SR_n$) at the nth level is conducted in response to the nth level pulse signal ($Sout_n$), so as to achieve time-divisional conduction of the plurality of the level shift circuits (LS), so that when the plurality of the shift registers (LS) are conducted, generated electron currents and a plurality of outputs ($out_1$, $out_2$, . . . , and $out_n$) of the charging compensation modules 100 are also achieved to be time divisional, solving a problem of electromagnetic interference caused by a superposition of electron current peaks.

Continuing to refer to FIGS. 4C-4D, when the plurality of the level shift circuits (LS) in each of the source driver chips (SD) are output at a same time, generated electron currents superimpose a peak, which is manifested as a problem of electromagnetic interference. However, the plurality of the level shift circuits (LS) are time-divisionally conducted, which generates electron currents time-divisionally, preventing a superposition of electron current peaks and reducing a risk of electromagnetic interference.

Figure 5A:
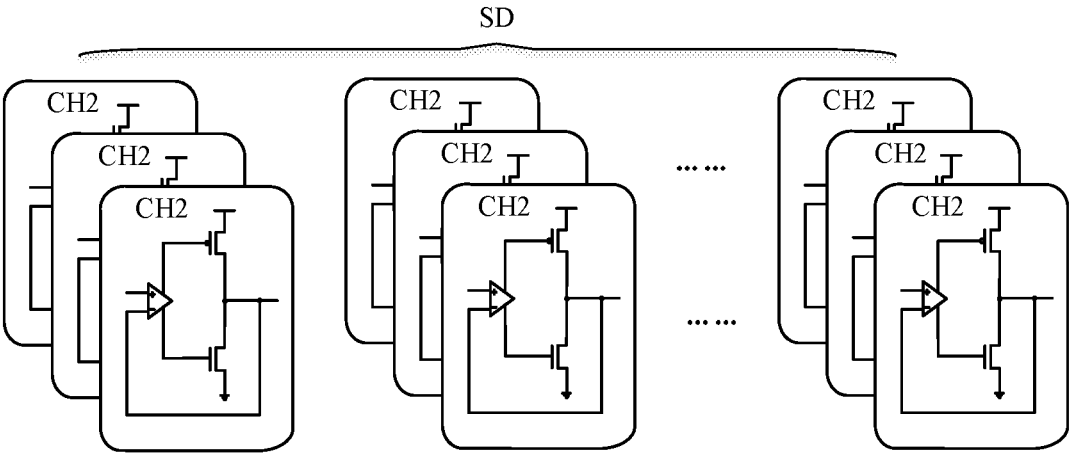
FIG. 5A is a schematic view of a plurality of the source driver chips included by the display panel provided by an embodiment of the present disclosure.
Figure 5B:
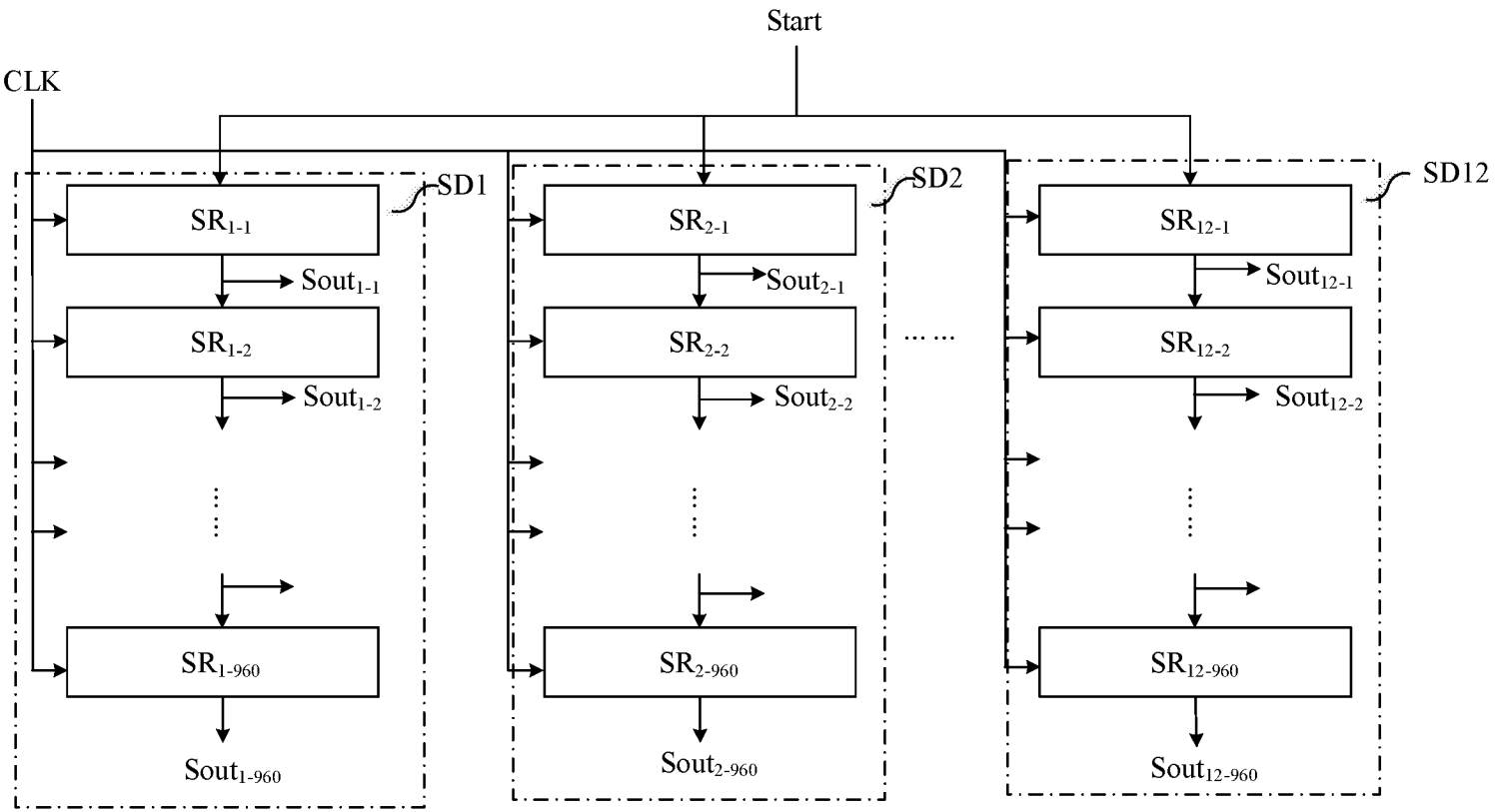
FIG. 5B and FIG. 5C are schematic views of the plurality of the shift registers cascadely connected when the display panel includes the plurality of the source driver chips provided by an embodiment of the present disclosure.
Figure 5C:
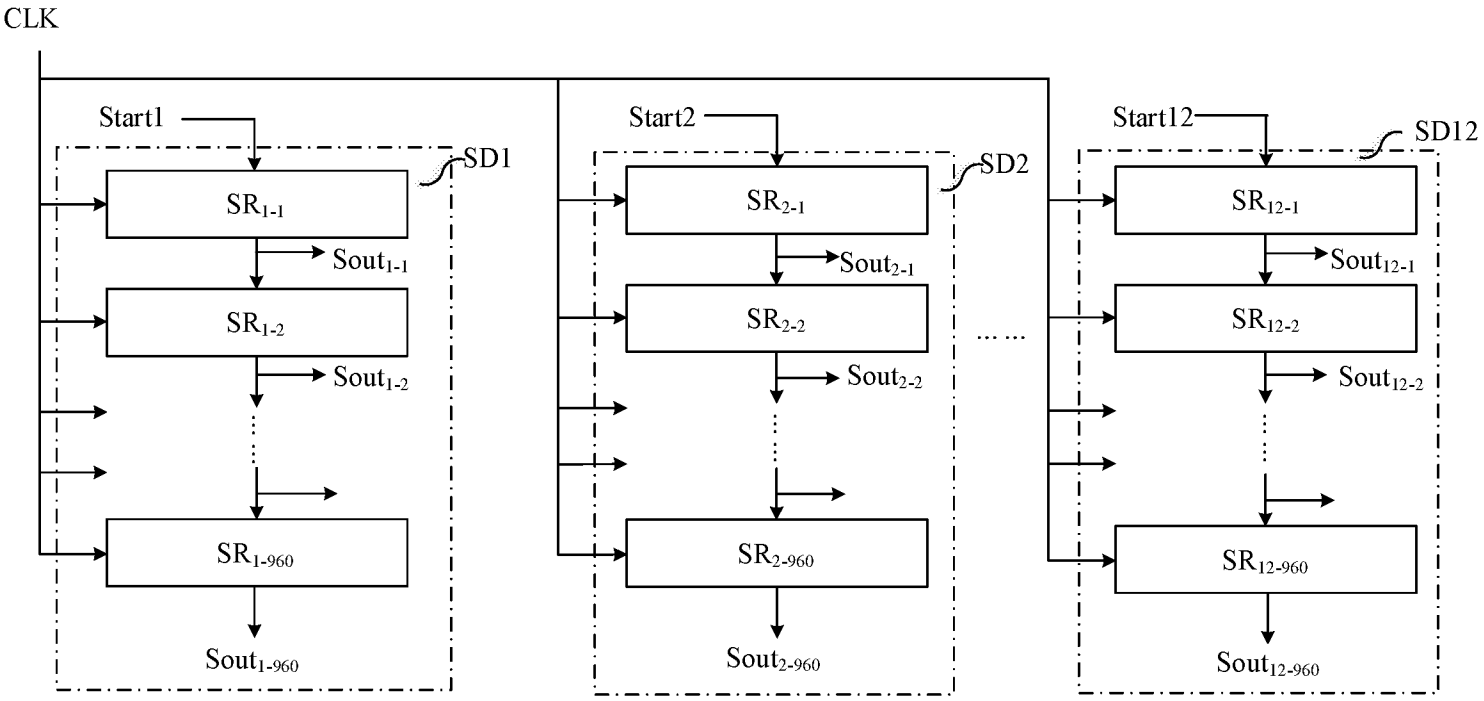
Figure 5D:
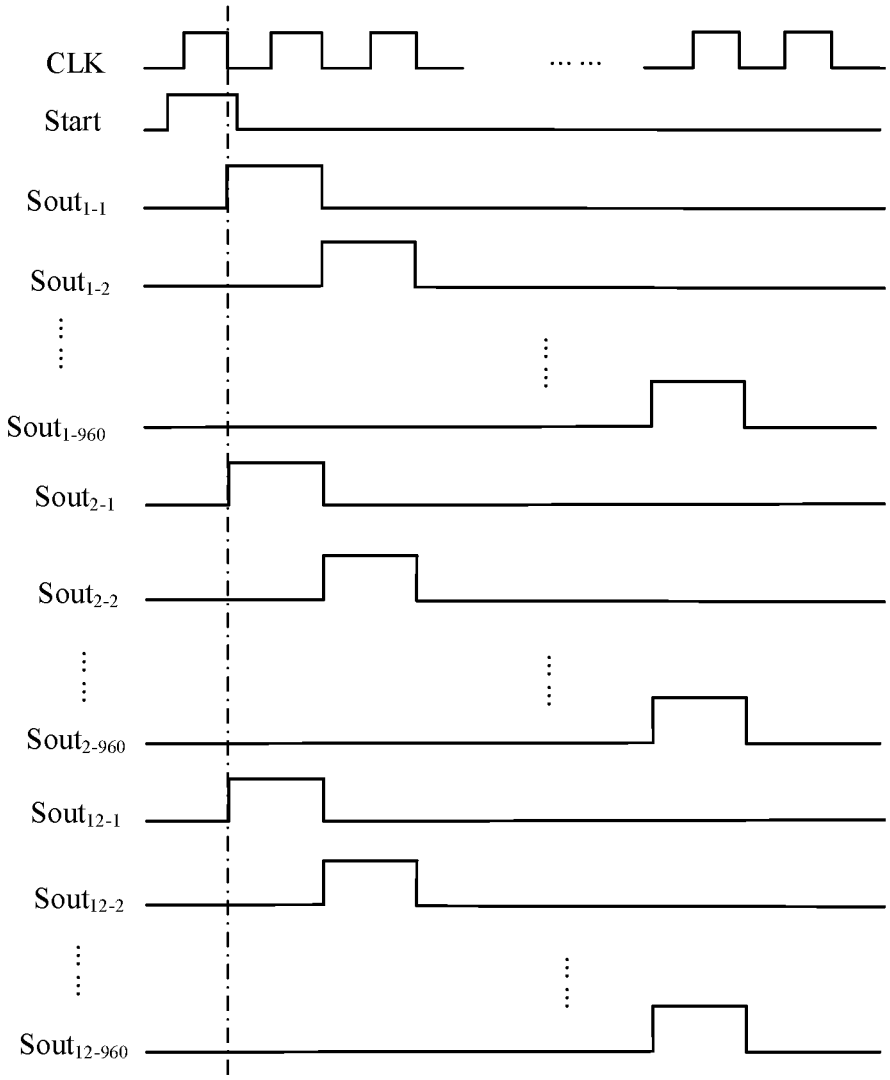
FIGS. 5D-5F are output timing diagrams of the plurality of the shift registers cascadely connected when the display panel includes the plurality of the source driver chips provided by an embodiment of the present disclosure.
Figure 5E:
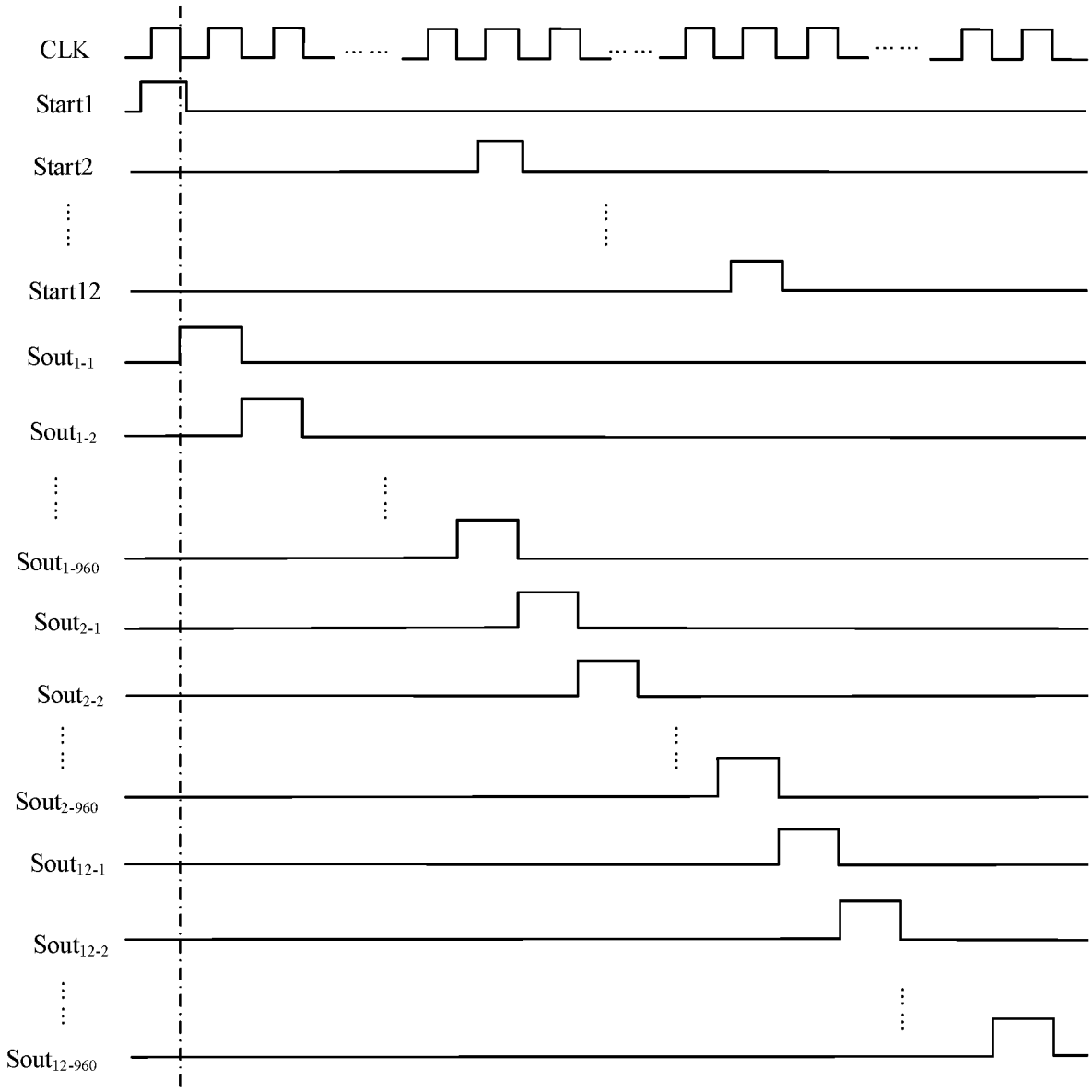
Figure 5F:
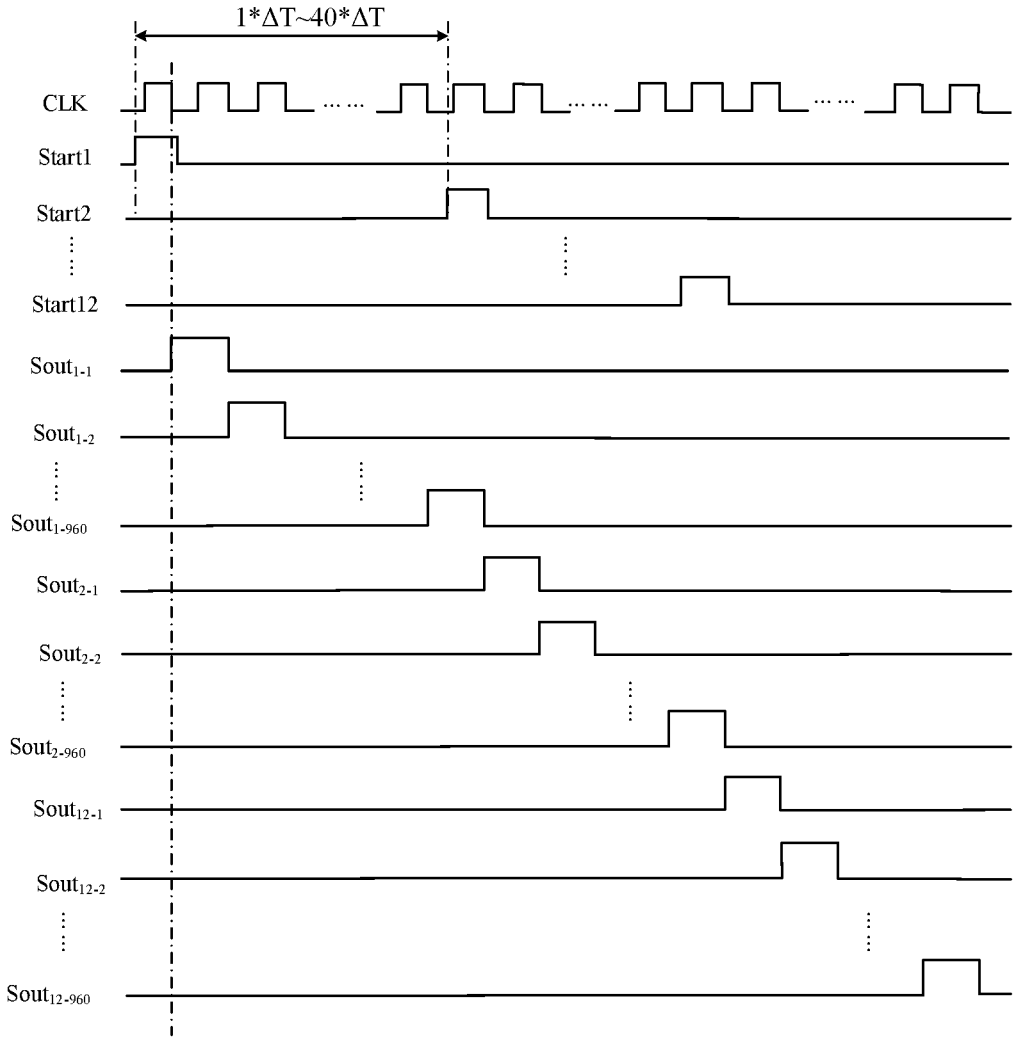

Referring to FIG. 5A, FIG. 5A is a schematic view of the plurality of the source driver chips included by the display panel provided by an embodiment of the present disclosure. As shown in FIG. 5B and FIG. 5C, FIG. 5B and FIG. 5C are schematic views of the plurality of the shift registers cascadely connected when the display panel includes the plurality of the source driver chips provided by an embodiment of the present disclosure. As shown in FIGS. 5D-5F, FIGS. 5D-5F are output timing diagrams of the plurality of the shift registers cascadely connected when the display panel includes the plurality of the source driver chips provided by an embodiment of the present disclosure. In order to meet requirements of high resolution, the display panel needs to be provided with the plurality of the source driver chips (SD), the plurality of the level shift circuits (LS) in the charging compensation modules 100 of the plurality of the source driver chips (SD) can be conducted and controlled by the cascaded control signal (CCS).

Referring to FIG. 3, FIG. 5B, and FIG. 5D, the display panel includes the plurality of the source driver chips (SD), each of the source driver chips (SD) includes one of the charging compensation modules 100, the shift registers (SR) in a plurality of the charging compensation modules 100 output the plurality of the pulse signals (Sout) in response to the clock signal (CLK) and the cascaded control signal (CCS) simultaneously, parts of the level shift circuits (LS) in the plurality of the charging compensation modules 100 are simultaneously conducted in response to corresponding parts of the pulse signals (Sout), and the plurality of the level shift circuits (LS) in a same charging compensation module 100 are time-divisionally conducted in response to the pulse signals (Sout) correspondingly.

Specifically, taking as an example the display panel including 12 source driver chips (SD) and each of the source driver chips (SD) including 960 output channels, each of the source driver chips (SD) includes a charging compensation module 100, and each of the charging compensation modules 100 includes the shift registers (SR) with 960 levels (i.e., 12 source driver chips (SD) include 12 charging compensation modules 100, having the shift registers (SR) with 12*960 levels). At a same time (i.e., the time in response to the clock signal (CLK) and the cascaded control signal (CCS)), there is a shift register (SR) in each of the charging compensation modules 100 outputting the pulse signals (Sout) in response to the clock signal (CLK) and the cascaded control signal (CCS) (i.e., if the first-level shift register of the shift registers (SR) with the plurality of levels in each of the charging compensation modules 100 outputs the first-level pulse signal in response to the clock signal (CLK) and the start signal (Start), and each level of the shift registers (SR) outputs one of the pulse signals (Sout) in response to corresponding one output of previous one level of the shift registers and the clock signal (CLK), a first-level shift register ($SR_{1-1}$) in a corresponding charging compensation module 100 of a first source driver chip (SD1), a first-level shift register ($SR_{2-1}$) in a corresponding charging compensation module 100 of a second source driver chip (SD2), . . . , and a first-level shift register ($SR_{12-1}$) in the charging compensation module 100 of a twelfth source driver chip (SD12) outputs 12 first-level pulse signals ($Sout_{1-1}$-$Sout_{12-1}$) in response to the clock signal (CLK) and the start signal (Start) simultaneously. After that, a second level shift register ($SR_{1-2}$) in the charging compensation module 100 of the first source driver chip (SD1), a second level shift register ($SR_{2-2}$) in the charging compensation module 100 of the second source driver chip (SD2), . . . , and a second level shift register ($SR_{12-2}$) in the charging compensation module 100 of the twelfth source driver chip (SD12) output 12 second level pulse signals ($Sout_{1-2}$-$Sout_{12-2}$) in response to the clock signal (CLK) and the first-level pulse signals ($Sout_{1-1}$-$Sout_{12-1}$) simultaneously. Hence, until 12 960-th level pulse signals ($Sout_{1-960}$-$Sout_{12-960}$) are output). So that the plurality of the level shift circuits (LS) in a same charging compensation module 100 are time-divisionally conducted, and parts of the level shift circuits (LS) in different charging compensation modules 100 are simultaneously conducted, which can reduce a risk of a problem of electromagnetic interference, short a working cycle of the plurality of the charging compensation modules 100, and is beneficial to achieve a design of high refresh rate of the display panel.

Continuing to refer to FIG. 3, FIG. 5C, and FIG. 5E, the display panel includes the plurality of the source driver chips (SD), each of the source driver chips (SD) includes the charging compensation module 100, the shift registers (SR) in a plurality of the charging compensation modules 100 output the plurality of the pulse signals (Sout) in response to the clock signal (CLK) and the cascaded control signal (CCS) sequentially, and the plurality of the level shift circuits (LS) in the plurality of the charging compensation modules 100 are time-divisionally conducted in response to the pulse signals (Sout) correspondingly and sequentially.

Further, the display panel includes the source driver chips with x levels, one of the charging compensation modules corresponding to a source driver chip at a y−1th level includes the shift registers with n levels, the cascaded control signal responded by one level of the shift registers in a corresponding one of the charging compensation modules of the source driver chip at a yth level lags behind the cascaded control signal responded by one level of the shift registers in a corresponding charging compensation module of the source driver chip at the y−1th level by n clock cycles, wherein y is greater than 1.

Specifically, taking the display panel including 12 (i.e., x=12) source driver chips (SD) and each of the source driver chips (SD) including 960 (i.e., n=960) output channels as an example, each of the source driver chips (SD) includes a charging compensation module 100, and each of the charging compensation modules 100 includes the shift registers (SR) with 960 levels (i.e., 12 source driver chips, SD, include 12 charging compensation modules 100, having the shift registers, SR, with 12*960 levels). If the first-level shift register of the shift registers (SR) with the plurality of levels in each of the charging compensation modules 100 outputs the first-level pulse signal in response to the clock signal (CLK) and the start signal (Start), and each level of the shift registers (SR) outputs one of the pulse signals (Sout) in response to corresponding one output of previous one level of the shift registers and the clock signal (CLK), the first-level shift register ($SR_{1-1}$) in corresponding one of the charging compensation modules 100 of the first source driver chip (SD1) outputs the first-level pulse signals ($Sout_{1-1}$) in response to the clock signal (CLK) and the start signal (Start1), after that, the second level shift register ($SR_{1-2}$) in the corresponding one of the charging compensation modules 100 of the first source driver chip (SD1) outputs the second level pulse signals ($Sout_{1-2}$) in response to the clock signal (CLK) and the first-level pulse signals ($Sout_{1-1}$). Hence, until a 960-th level pulse signal ($Sout_{1-960}$) are output. After that, a first-level shift register ($SR_{2-1}$) in corresponding one of the charging compensation modules 100 of the second source driver chip (SD2) outputs a first-level pulse signals ($Sout_{2-1}$) in response to the clock signal (CLK) and a start signal (Start2), hence, until a 960-th level shift register ($SR_{12-960}$) of the twelfth source driver chip (SD12) outputs a 960-th level pulse signals ($Sout_{12-960}$). Further, the start signal (Start2) may refer to the 960-th level pulse signal ($Sout_{1-960}$) output by a 960-th level shift register ($SR_{1-960}$) of the first source driver chip (SD1).

In addition, a control of the plurality of the charging compensation modules can also be achieved by setting a fixed clock cycle, as shown in FIG. 3, FIG. 5C, and FIG. 5F. That is, when the display panel includes the source driver chips with x levels, the cascaded control signal responded by one level of the shift registers in a corresponding one of the charging compensation modules of one of the source driver chips at the yth level lags behind the cascaded control signal responded by one level of the shift registers in a corresponding charging compensation module of the source driver chips at the y−1th level by 1*ΔT-40*ΔTs, and wherein y is greater than 1, and ΔT refers to a unit period. x can be set according to actual needs of the display panel, and further, the x is equal to 6, 12,16, 24, 32, 48, or 64, etc.

Further, the unit period ΔT is greater than or equal to 1*UI, wherein the UI and a transmission speed of the source driver chips are reciprocal to each other. Wherein the UI can be equal 300 MHz, and ΔT is greater than or equal to 3.3 nanoseconds.

Continuing to refer to FIG. 1, the display panel further includes a timing controller 200, and the timing controller 200 is configured to generate the clock signal (CLK) and the start signal (Start).

Further, the display panel further includes at least one gate driver chip 300, the at least one gate driver chip 300 is configured to drive a plurality of pixels in the display panel to emit light together with the source driver chips (SD), to realize display of the display panel.

Continuing to refer to FIG. 2 and FIG. 3, each of the source driver chips (SD) includes a latch 101, and the latch 101 includes a charging compensation module 100, each of the charging compensation modules 100 includes a programmable panel charging compensation module.

Further, the latch 101 further includes:

a first latch module 1011 configured to latch display data of a next row;

a second latch module 1012 connected to the first latch module 1011 and configured to latch display data of a current row; and a third latch module 1013 connected to the second latch module 1012 and configured to realize an output delay of the display data of the current row. And the third latch module 1013 includes the charging compensation module 100.

Further, each of the source driver chips further includes:

a digital analog converter 102 connected to the latch 101 and configured to convert a voltage signal output by one of the level shift circuits (LS) into a grayscale voltage signal; and a data buffer 103 connected to the digital analog converter 102 and configured to output an electron current for driving the display panel to display. Wherein, $CH_1$-$CH_n$ refer to channels of 1-n, n can be set according to actual needs of the display panel; for example, n is equal to 960.

Further, each of the source driver chips (SD) includes a data receiving module 104, and the data receiving module 104 is configured to store data (Data) of an extra bus line according to an input clock signal (CLK1). Further, the data receiving module 104 includes a first shift register 1041 and a data register 1042.

The first shift register 1041 is configured to output a pulse signal according to the input clock signal (CLK1) and control the data register 1042 gating correspondingly, so as to sequentially store the data (Data) into the data register. When a control signal input by the latch is valid, content of the data register 1042 is latched in the latch 101, and after action of one of the level shift circuits (LS), a logic voltage level is converted into a driving voltage level. Then, under action of a digital analog converter 102 and the data buffer 103, signals that can drive different display gray levels are generated to output to a source electrode of thin film transistors located in a display region of the display panel, to achieve display control of the display panel.

Wherein, if the latch 101 reads and latches the data of the data register 1042 while the latch inputs a rising edge of a control signal, the data of the latch 101 is latched and is provided to the digital analog converter 102 of a next level to output a corresponding grayscale voltage while a control signal input by the latch is at a low level, and at this time, the data register 1042 can continue to capture data of a next line to be displayed, thereby realizing a function that the data register 1042 can continue to capture data of a next line to be displayed while sending a grayscale to be displayed.

Figure 6A:
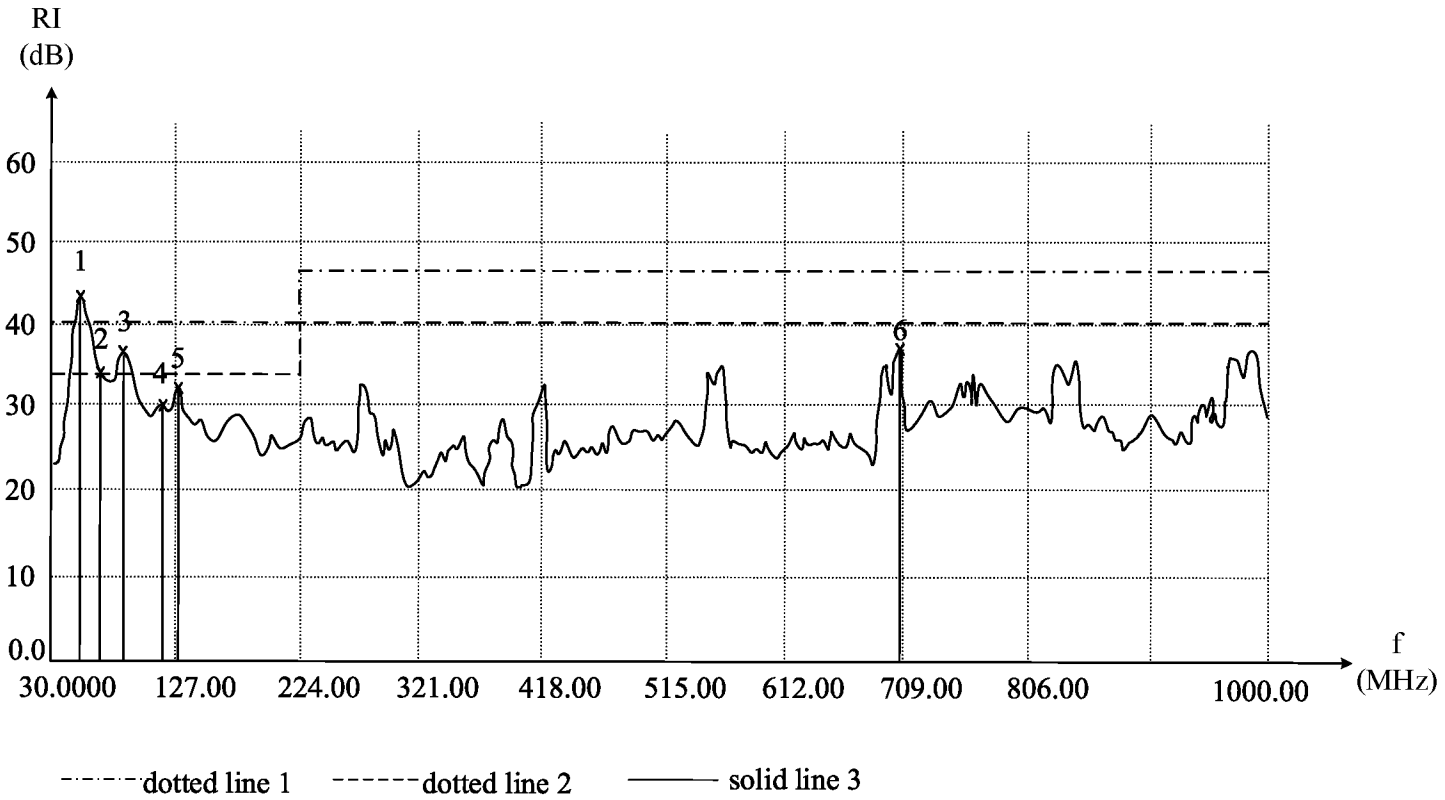
FIG. 6A is a testing view before alleviating electromagnetic interference provided by an embodiment of the present disclosure.
Figure 6B:
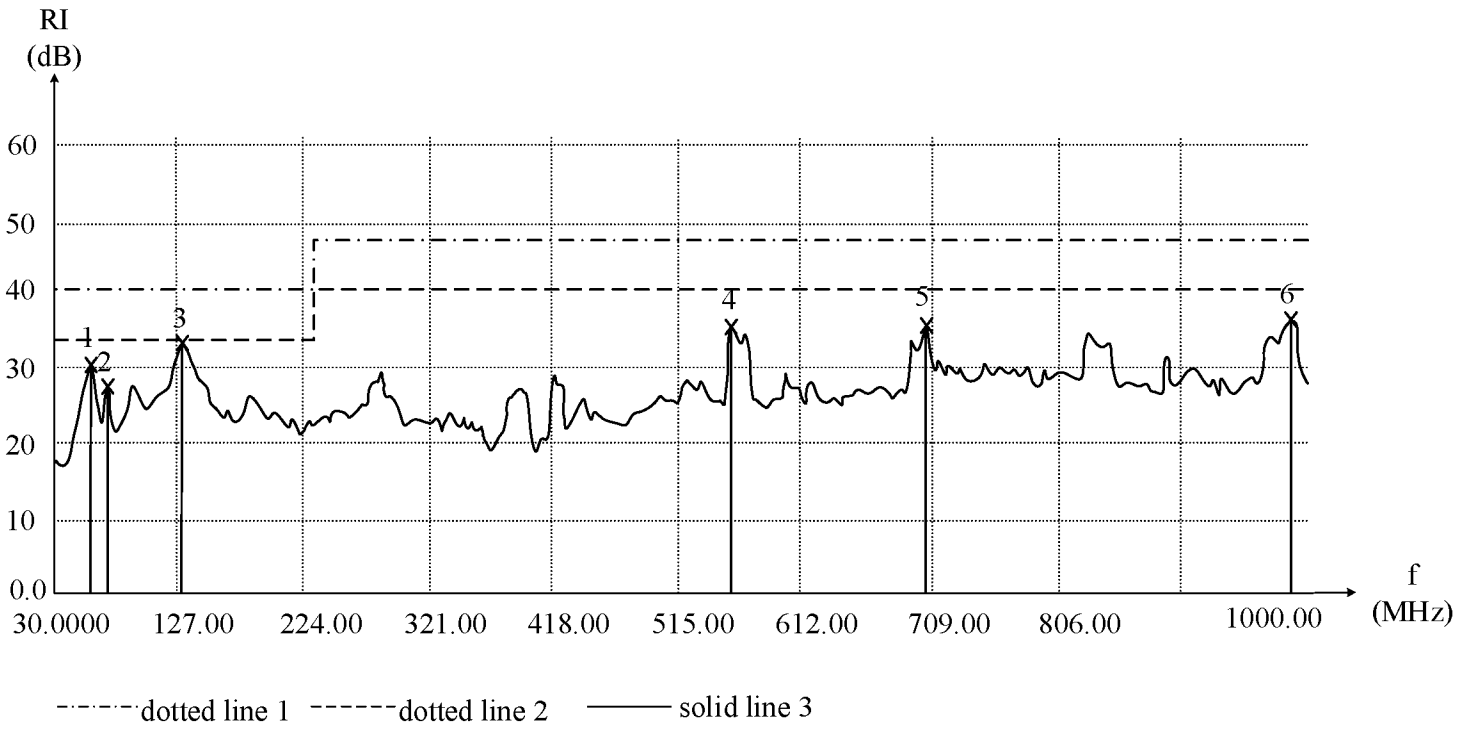
FIG. 6B is a testing view after alleviating electromagnetic interference provided by an embodiment of the present disclosure.

As shown in FIG. 6A, FIG. 6A is a testing view before alleviating electromagnetic interference provided by an embodiment of the present disclosure. As shown in FIG. 6B, FIG. 6B is a testing view after alleviating electromagnetic interference provided by an embodiment of the present disclosure. Wherein, in FIG. 6A and FIG. 6B, an abscissa refers to frequency (f) (using megahertz, MHz, as unit), and an ordinate refers to radiation intensity (RI) (using decibel, dB, as unit). A dotted line 1 refers to an electromagnetic interference radiation standard line, a dotted line 2 refers to a line 6 dB below the standard line, and a solid line 3 refers to a measured electromagnetic interference curve. Taking frequency point of 59.1 MHz as an example, measurement results before and after improvement measured by an electromagnetic interference far-field radiation receiver are shown in Table 1.

TABLE 1

| before improvement | | | | | | | |
|---|---|---|---|---|---|---|---|
| | parameter | | | | | | |
| serial number | frequency point (MHz) | redaing (dBuV) | revise (dB) | result (dBuV) | range (dBuV) | margin (dB) | label |
| 1 | 51.8250 | 69.62 | −26.49 | 43.13 | 40.00 | 3.13 | peak |
| 2 | 71.2250 | 64.89 | −26.69 | 35.20 | 40.00 | −4.80 | peak |
| after improvement | | | | | | | |
| | parameter | | | | | | |
| serial number | frequency point (MHz) | reading (dBuV) | revise (dB) | result (dBuV) | range (dBuV) | margin (dB) | remark |
| 1 | 59.1000 | 57.43 | −27.30 | 30.13 | 40.00 | −9.87 | peak |
| 2 | 71.2250 | 57.95 | −29.69 | 28.26 | 40.00 | −11.74 | peak |

It can be seen from FIG. 6A, FIG. 6B and the Table 1 that overall electromagnetic interference margin after improvement becomes larger, and a level of electromagnetic interference improvement is getting better. Changing from 3.13 dB (51.825 MHz) exceeding standard and −4.8 dB (71.225 MHz) to −9.87 dB (59.1 MHz) and −11.74 dB (71.225 MHz) after improvement, radiation value is greatly reduced, electromagnetic interference optimization effect is obvious, it can meet testing standards, it is beneficial for improve reliability of products.

The present disclosure further provides a display device including the above-mentioned display panel.

Further, the display device further includes sensors, the sensors include cameras, light sensors, distance sensors, gravity sensors, etc. The display device includes a flexible display device, a liquid crystal display device, a touch display device, etc. Further, the display device includes a computer, a mobile phone, a bracelet, etc.

In the foregoing embodiments, the description of each of the embodiments has respective focuses. For a part that is not described in detail in an embodiment, reference may be made to relevant descriptions in other embodiments. The embodiments of the present disclosure are described in detail above. The principle and implementations of the present disclosure are described in this specification by using specific examples. The description about the foregoing embodiments is merely provided to help understand the method and core ideas of the present disclosure. persons of ordinary skill in the art should understand that they may still make modifications to the technical solutions described in the foregoing embodiments or make equivalent replacements to some or all technical features thereof, without departing from the scope of the technical solutions of the embodiments of the present disclosure.

What is claimed is:

1. A display panel, wherein the display panel comprises source driver chips, the source driver chips comprise charging compensation modules, and each of the charging compensation modules comprises:

a plurality of shift registers cascadely connected and configured to time-divisionally output a plurality of pulse signals in response to a clock signal and a cascaded control signal; and a plurality of level shift circuits, wherein each of the level shift circuits is connected to a corresponding shift register, and the plurality of the level shift circuits are configured to be time-divisionally conducted in response to the plurality of the pulse signals;

wherein each of the source driver chips comprises a latch, and the latch comprises:

a first latch module configured to latch display data of a next row;

a second latch module connected to the first latch module and configured to latch display data of a current row; and a third latch module connected to the second latch module and configured to realize an output delay of the display data of the current row, and the third latch module comprising the charging compensation module.

2. The display panel according to claim 1, wherein the display panel comprises a plurality of the source driver chips, each of the source driver chips comprises one of the charging compensation modules, the shift registers in a plurality of the charging compensation modules output the plurality of the pulse signals in response to the clock signal and the cascaded control signal simultaneously, parts of the level shift circuits in the plurality of the charging compensation modules are simultaneously conducted in response to corresponding parts of the pulse signals, and the plurality of the level shift circuits in a same charging compensation module are time-divisionally conducted in response to the pulse signals correspondingly.

3. The display panel according to claim 1, wherein the display panel comprises a plurality of the source driver chips, each of the source driver chips comprises one of the charging compensation modules, the shift registers in a plurality of the charging compensation modules output the plurality of the pulse signals in response to the clock signal and the cascaded control signal sequentially, and the plurality of the level shift circuits in the plurality of the charging compensation modules are time-divisionally conducted in response to the pulse signals correspondingly and sequentially.

4. The display panel according to claim 3, wherein the display panel comprises the source driver chips with x levels, one of the charging compensation modules corresponding to a source driver chip at a y−1th level comprises the shift registers with n levels, the cascaded control signal responded by one level of the shift registers in a corresponding charging compensation module of a source driver chip at a yth level lags behind the cascaded control signal responded by one level of the shift registers in a corresponding charging compensation module of the source driver chip at the y−1th level by n clock cycles, wherein y is greater than 1.

5. The display panel according to claim 3, wherein the display panel comprises the source driver chips with x levels, and the cascaded control signal responded by one level of the shift registers in a corresponding one of the charging compensation modules of one of the source driver chips at a yth level lags behind the cascaded control signal responded by one level of the shift registers in a corresponding charging compensation module of the source driver chips at a y−1th level by $1*\Delta T-40*\Delta Ts$, wherein y is greater than 1, and $\Delta T$ refers to a unit period.

6. The display panel according to claim 5, wherein the unit period $\Delta T$ is greater than or equal to 1*UI, wherein the UI and a transmission speed of the source driver chips are reciprocal to each other.

7. The display panel according to claim 5, wherein $\Delta T$ is greater than or equal to 3.3 nanoseconds.

8. The display panel according to claim 1, wherein the cascaded control signal comprises a start signal, and a first-level shift register in each of the charging compensation modules outputs a first-level pulse signal in response to the clock signal and the start signal.

9. The display panel according to claim 8, wherein the display panel comprises a timing controller, and the timing controller is configured to generate the clock signal and the start signal.

10. The display panel according to claim 1, wherein each of the charging compensation modules comprises the shift registers with N levels, and one of the shift registers at an mth level outputs an mth level pulse signal in response to the clock signal and a m−1th level pulse signal output by one of the shift registers at a m−1th level, wherein m is greater than 1 and less than or equal to n.

11. The display panel according to claim 1, wherein the latch comprises a charging compensation module.

12. The display panel according to claim 11, wherein each of the source driver chips comprises:

a digital analog converter connected to the latch and configured to convert a voltage signal output by one of the level shift circuits into a grayscale voltage signal; and a data buffer connected to the digital analog converter and configured to output an electron current for driving the display panel to display.

13. The display panel according to claim 1, wherein each of the source driver chips comprises a data receiving module, and the data receiving module is configured to store data of an extra bus line according to an input clock signal.

14. The display panel according to claim 13, wherein the data receiving module comprises:

a data register configured to store the data; and a first shift register configured to output a pulse signal according to the input clock signal and control the data register gating correspondingly, so as to sequentially store the data into the data register.

15. A display device, wherein the display device comprises a display panel, the display panel comprises source driver chips, the source driver chips comprise charging compensation modules, and each of the charging compensation modules comprises:

a plurality of shift registers cascadely connected and configured to time-divisionally output a plurality of pulse signals in response to a clock signal and a cascaded control signal; and a plurality of level shift circuits, wherein each of the level shift circuits is connected to a corresponding shift register, and the plurality of the level shift circuits are configured to be time-divisionally conducted in response to the plurality of the pulse signals;

wherein each of the source driver chips comprises a latch, and the latch comprises:

a first latch module configured to latch display data of a next row;

a second latch module connected to the first latch module and configured to latch display data of a current row; and a third latch module connected to the second latch module and configured to realize an output delay of the display data of the current row, and the third latch module comprising the charging compensation module.

16. The display device according to claim 15, wherein the display panel comprises a plurality of the source driver chips, each of the source driver chips comprises one of the charging compensation modules, the shift registers in a plurality of the charging compensation modules output the plurality of the pulse signals in response to the clock signal and the cascaded control signal simultaneously, parts of the level shift circuits in the plurality of the charging compensation modules are simultaneously conducted in response to corresponding parts of the pulse signals, and the plurality of the level shift circuits in a charging compensation module are time-divisionally conducted in response to the pulse signals correspondingly.

17. The display device according to claim 15, wherein the display panel comprises a plurality of the source driver chips, each of the source driver chips comprises one of the charging compensation modules, the shift registers in a plurality of the charging compensation modules output the plurality of the pulse signals in response to the clock signal and the cascaded control signal sequentially, and the plurality of the level shift circuits in the plurality of the charging compensation modules are time-divisionally conducted in response to the pulse signals correspondingly and sequentially.

18. The display device according to claim 17, wherein the display panel comprises the source driver chips with x levels, one of the charging compensation modules corresponding to a source driver chip at a y−1th level comprises the shift registers with n levels, the cascaded control signal responded by one level of the shift registers in a corresponding charging compensation module of a source driver chip at a yth level lags behind the cascaded control signal responded by one level of the shift registers in a corresponding charging compensation module of the source driver chip at the y−1th level by n clock cycles, wherein y is greater than 1.

19. The display device according to claim 17, wherein the display panel comprises the source driver chips with x levels, and the cascaded control signal responded by one level of the shift registers in a corresponding one of the charging compensation modules of one of the source driver chips at a yth level lags behind the cascaded control signal responded by one level of the shift registers in a corresponding charging compensation module of the source driver chips at a y−1th level by 1*ΔT-40*ΔTs, wherein y is greater than 1, and ΔT refers to a unit period.

* * * * *